US008591147B2

(12) United States Patent
Quigley et al.

(10) Patent No.: US 8,591,147 B2
(45) Date of Patent: Nov. 26, 2013

(54) COMBINED WATER STORAGE AND DETENTION SYSTEM AND METHOD OF PRECIPITATION HARVESTING AND MANAGEMENT

(75) Inventors: Marcus Quigley, Brookline, MA (US); Philip Reidy, Brookline, MA (US)

(73) Assignee: Geosyntec Consultants, Inc., Boca Raton, FL (US)

( * ) Notice: Subject to any disclaimer, the term of this patent is extended or adjusted under 35 U.S.C. 154(b) by 318 days.

(21) Appl. No.: 12/951,531

(22) Filed: Nov. 22, 2010

(65) Prior Publication Data

US 2011/0120561 A1 May 26, 2011

Related U.S. Application Data

(60) Provisional application No. 61/263,138, filed on Nov. 20, 2009.

(51) Int. Cl.
*E03F 1/00* (2006.01)

(52) U.S. Cl.
USPC ..... 405/92; 405/37; 137/236.1; 137/386; 239/69

(58) Field of Classification Search
USPC ..... 405/36, 37, 39, 40, 51, 52, 80, 87, 92; 137/236.1, 255, 256, 386, 391, 565.01, 137/565.11, 571; 239/69, 70; 210/747.2
See application file for complete search history.

(56) References Cited

U.S. PATENT DOCUMENTS

| | | | | |
|---|---|---|---|---|
| 4,180,083 | A * | 12/1979 | Miyaoka et al. | 137/101.25 |
| 5,342,144 | A * | 8/1994 | McCarthy | 405/39 |
| 6,145,755 | A * | 11/2000 | Feltz | 239/1 |
| 6,796,325 | B1 * | 9/2004 | Courier | 137/357 |
| 7,186,058 | B2 * | 3/2007 | Schluter et al. | 405/80 |

OTHER PUBLICATIONS

"New Directions in Real-Time and Dynamic Control for Stormwater Management and Low Impact Development"; Marcus Quigley, P.E., CPESC, Sri Rangarajan, Ph.D.E., Daniel Pankani, P.E., Dawn Henning, EIT ,World Environmental and Water Resources Congress, May 2008, pp. 1-7.

* cited by examiner

*Primary Examiner* — Tara M. Pinnock
(74) *Attorney, Agent, or Firm* — Preti Flaherty Beliveau & Pachios LLP

(57) ABSTRACT

In a water storage system with water conduits, water pumps, drain valves, discharge valves, for storing a first volume of water, a method of maximizing water availability monitors a second volume of water within the system. Data regarding forecasted precipitation predicted to occur at some point in the future, including a predicted duration, intensity and volume are received and an expected time-dependent volume of water to be added to the system during the forecasted precipitation is estimated. If at least one of: a first sum of the predicted volume and the second volume and a second sum of the expected time-dependent volume and the second volume is greater than the first volume then the water pumps, drain valves, and discharge valves are controlled to discharge water until each of the first and second sums is not greater than the first volume.

7 Claims, 3 Drawing Sheets

NON-MONITORING SYTEM

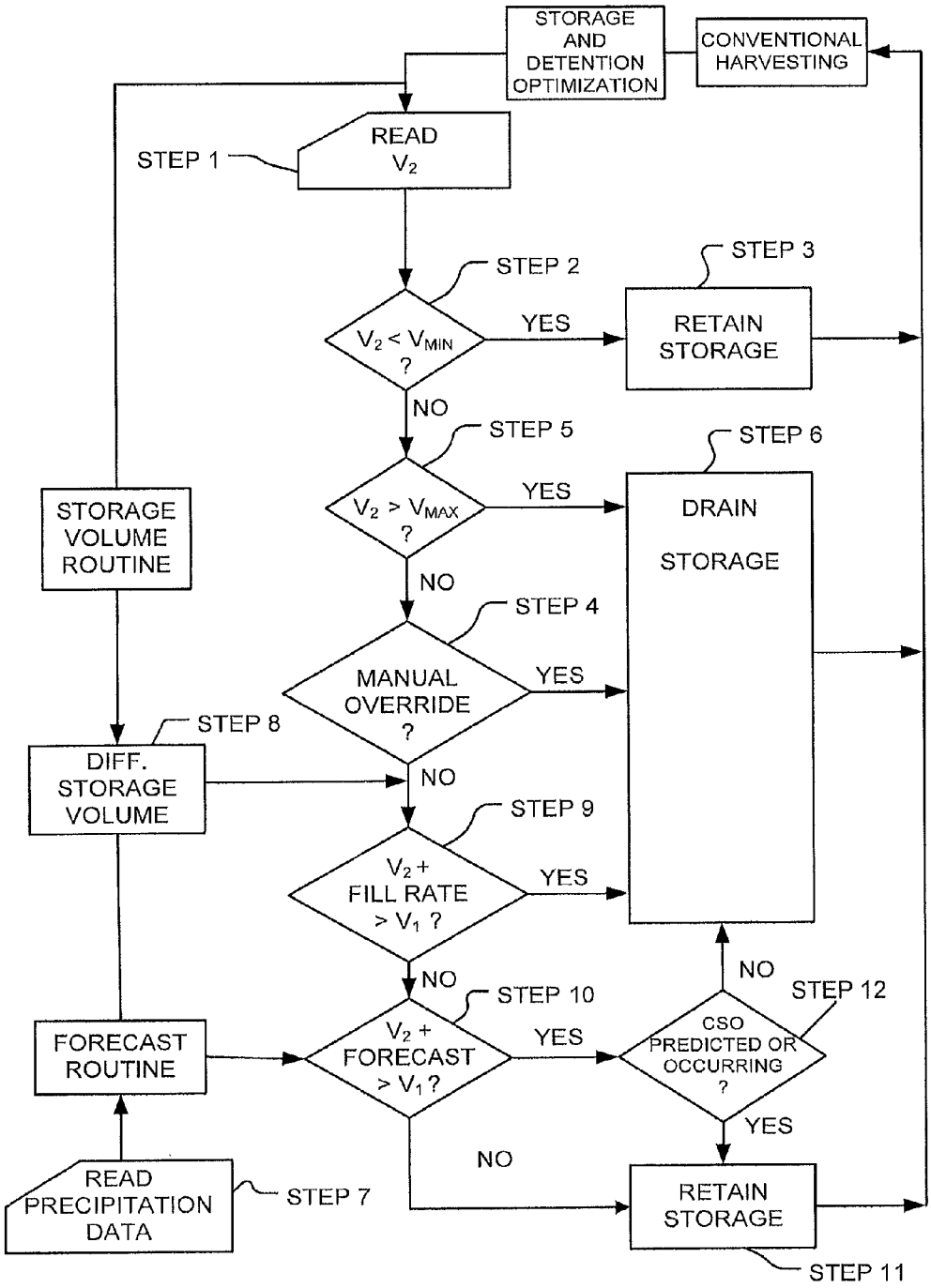
*FIG. 3* MONITORING SYTEM

COMBINED WATER STORAGE AND DETENTION SYSTEM AND METHOD OF PRECIPITATION HARVESTING AND MANAGEMENT

CROSS-REFERENCE TO RELATED APPLICATIONS

This application claims the benefit of U.S. Provisional Application No. 61/263,138, which was filed on Nov. 20, 2009.

STATEMENT REGARDING FEDERALLY SPONSORED RESEARCH OR DEVELOPMENT

Not Applicable

BACKGROUND OF THE INVENTION

Onsite collection, temporary storage, and use of precipitation-generated runoff and other excess site water, e.g. from underdrain and sump pump discharges, stored in temporary water storage structures and cisterns have been used for a myriad of purposes for thousands of years. The potential benefits of these systems are increasingly of interest to regulators, water and sewer operators and managers, engineers, architects, and landscape architects involved in site and building design and, as such, are being integrated more and more into urban runoff management systems.

In many areas of the United States, onsite collection, storage, and use of excess site water and precipitation-generated runoff, which is referred to as "harvesting", "rainwater harvesting" and/or "site water harvesting", have seen increased integrated into new and existing construction as interest in resource conservation and sustainable building practices have expanded. Not insignificantly, the U.S. Environment Protection Agency (USEPA) in its 2008 Rainwater Harvesting Policies Handbook states that, "Rainwater harvesting has significant potential to provide environmental and economic benefits by reducing stormwater runoff and conserving potable water . . . ." However, despite the expansion of these practices there has been limited evaluation of methods for optimal control of these systems.

To achieve the full benefits of harvesting, one must maximize the availability of stored water for use while minimizing volume overflowing from or bypassing the storage system into downstream water bodies. Conventional practices tend to emphasize only one potential benefit, which is to say, either storm water management or water conservation, but not both, without considering the potential to optimize a system to address both benefits.

Moreover, current control systems do not include sophisticated control logic that addresses these limitations. Indeed, and most critically, existing systems rarely utilize network-based weather forecasting information in order to anticipate the likely volume of future precipitation, e.g., water or snowmelt, that may be added to the storage system during a future precipitation event or current precipitation being contemporaneously added to the storage system and act on this information in affecting the volume maintained in the storage structure.

SUMMARY OF THE INVENTION

A combined water storage and detention (CWSD) system for maximizing storm and sewer drain water use is disclosed. The CWSD system includes a plurality of water conduits, remotely controllable water pumps, water storage drain valves, auxiliary bypass discharge valves, and, in pertinent part, a storage/detention system for storing/retaining a first volume of storm water, a sensing device for estimating a second volume of storm water within the storage/detention system, the second volume being less than or equal to the first volume, e.g., the maximum storage volume of the storage/detention system, a precipitation forecast device for forecasting an expected time-dependent volume of water ("forecast volume") being added to or to be added to the system, and a controller that is structured and arranged to control the operating states of the plurality of controllable water pumps, water storage draining valves, and auxiliary bypass discharge valves. Preferably, the precipitation forecast device provides weather precipitation parameter data from one or more network sources such as the World Wide Web, the Internet, a local area network (LAN), and a wide area network (WAN) and the controller is adapted to interpret sensing device signal data to determine whether the second volume plus the forecast volume is greater than the first volume (for a non-monitoring system).

In operation, the controller is adapted to maintain the water storage drain valve in a closed position when the second volume is less than or equal to the maximum storage volume and/or to open the water storage drain valve when the second volume is greater than the maximum storage volume. Indeed, the controller is further adapted to estimate forecasted precipitation event water volume that will likely arrive in the storage/detention system in the near future and to activate at least one of the plurality of water pumps and/or to activate at least one of the plurality of auxiliary bypass discharge valves when the second volume plus the forecast volume is greater than the maximum storage volume of the storage/detention system.

More particularly, the controller is adapted to close the water storage drain valve when the summation of the second volume and the forecast volume of water is less than or equal to the maximum storage volume i.e., the first volume; to open the water storage drain valve and to activate at least one of the plurality of water pumps and/or to activate at least one of the plurality of auxiliary bypass discharge valves when the summation of the second volume and the forecast volume of water is greater than the maximum storage volume; and to close the water storage drain valve when the summation of the second volume plus the forecast volume is greater than the first volume and when the monitored external conveyance, viz. a combined or separate sewer system, is flowing above or predicted to be flowing above its capacity.

Optionally, the CWSD system can include additional logic to determine if, at the current fill rate and volume stored in the system, the system is projected to overflow during the current storm event and act accordingly, e.g., open the storage drain valve; to determine if the stored water volume is less than a pre-established minimum storage volume; to determine if the stored water volume is greater than a pre-established maximum storage volume; to provide for a manual override for user control of the system; and, in these instances, to act accordingly corresponding to the logic applied to the system.

In another embodiment, a method of controlling impacts to drainage infrastructure or receiving water bodies (a "remote system") downstream of the CWSD system is disclosed. The method of interrogating sensors installed in downstream drainage infrastructure or receiving water bodies includes controlling the operating states of the system, the plurality of controllable water pumps, draining valves, and auxiliary bypass discharge valves.

An operating state that includes additional sensing devices in a remote combined system during an actual precipitation event is called a "positive state" (logic 1) while an operating state that does not include additional sensing devices in a remote system is referred to as a "negative state" (logic 0).

In operation, using, inter alia, water level or flow data from a sensing device(s) in a remote system and precipitation parameter data from the network source, the controller is adapted to estimate flows into the remote system from a forecast precipitation event. The controller is further adapted to override normal functionality and close the CWSD system water storage drain valve; to activate or deactivate at least one of the plurality of water pumps; and/or to activate or deactivate at least one of the plurality of auxiliary bypass discharge valves when a monitored, remote system is at or projected to be at flow capacity and the CWSD system state is positive.

BRIEF DESCRIPTION OF THE SEVERAL VIEWS OF THE DRAWINGS

Other features and advantages of the invention will be apparent from the following description of the preferred embodiments thereof and from the claims, taken in conjunction with the accompanying drawings, in which:

FIG. 3 shows a flow chart of a method of maximizing the availability of water for use in a combined water storage and temporary detention system for a monitoring CWSD system (logic 1).

DETAILED DESCRIPTION OF THE PREFERRED EMBODIMENTS OF THE INVENTION

U.S. Provisional Application No. 61/263,138, from which the benefit of priority is claimed, is incorporated herein in its entirety by reference.

Combined Water Storage and Detention System

Figure 1:
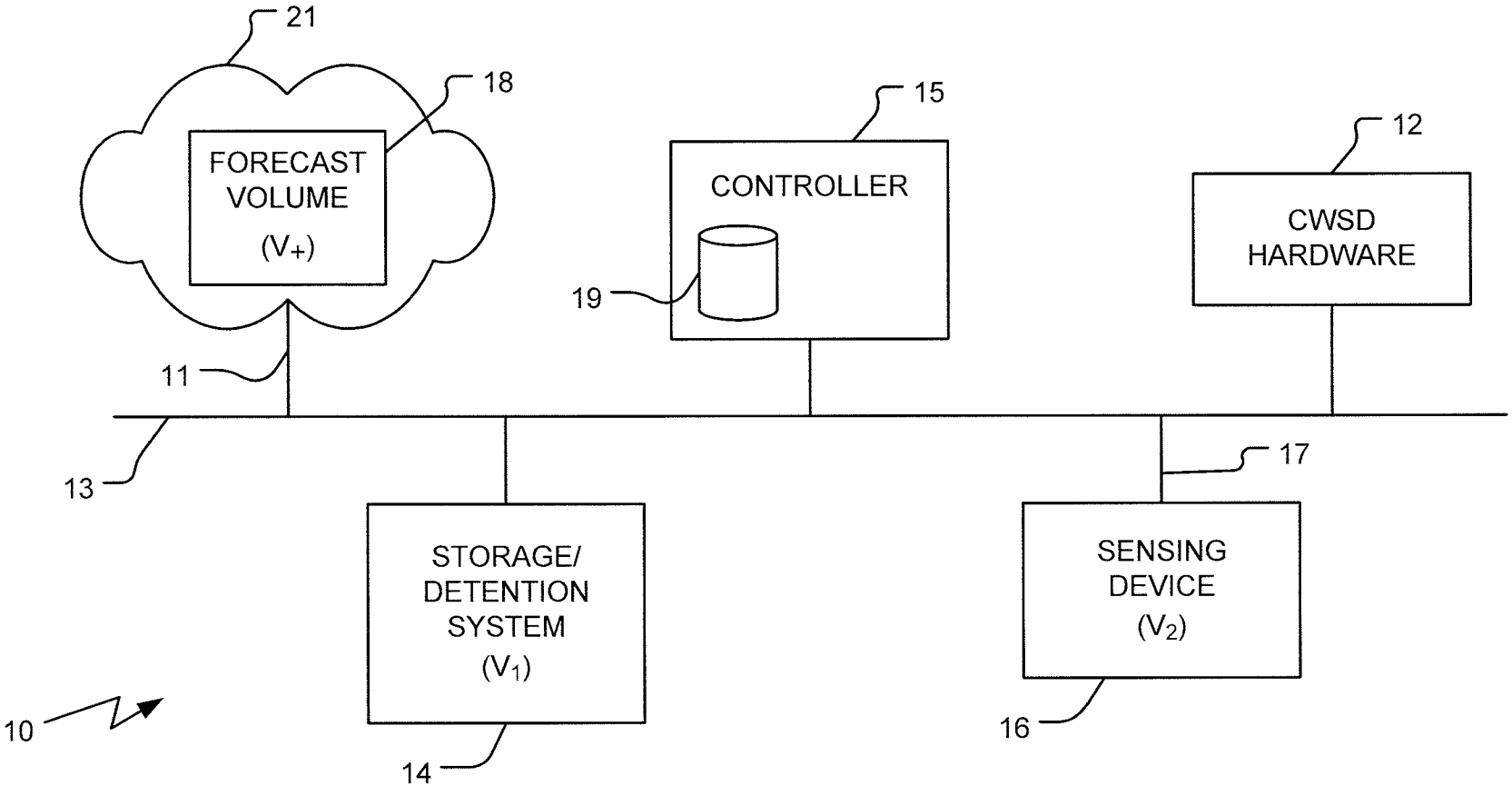
FIG. 1 shows a block diagram of a combined onsite water storage and detention (CWSD) system in accordance with the present invention.

Referring to FIG. 1, a combined water storage and detention (CWSD) system will be described. The embodied CWSD system 10 includes a plurality of ancillary portions and devices 12 such as water conduits, remotely controllable water pumps, water storage drain valves, auxiliary bypass discharge valves, and the like, which are common to conventional harvesting and cistern systems. In pertinent part, the CWSD system 10 further includes a storage/detention system 14 for storing and/or retaining a first volume ($V_1$) of water; a sensing device 16 for estimating a second volume ($V_2$) of water that is currently contained in the storage/detention system 14; a precipitation forecast device 18 for forecasting a time-dependent volume of water ($V_+$) that is to be added to the storage/detention system 14; and a controller 15 that is structured and arranged to control the operating states of the plurality of controllable water pumps, water storage draining valves, and auxiliary bypass discharge valves and other ancillary portions 12 of the CWSD system 10. By definition, the second volume ($V_2$) is less than or equal to the first volume ($V_1$).

Preferably, the precipitation forecast device 18 provides weather precipitation data 11 that are gathered from at least one source from an on-line network 21, e.g., the World Wide Web, the Internet, a local area network (LAN), a wide area network (WAN), a dedicated weather data server, and the like. Weather data 11 can include, without limitation, a precipitation intensity (I), an expected time of the precipitation event (T), an expected duration of the precipitation event (D), and so forth. These weather data 11 can also include a melting temperature ($T_M$) that can be used to determine ice or snow melt variables. Accordingly, for the purpose of this disclosure, a precipitation event would also include a temperature change that would cause snow or ice to melt.

These data 11 are provided, e.g., via a communication bus 13, to a processing device, which is to say the controller 15 or a discrete processing device (not shown) provided for that specific purpose. The processing device is structured and arranged to include a central processing unit (CPU) having volatile memory storage, e.g., random access memory (RAM), and non-volatile memory, e.g., read-only memory (ROM), and a plurality of input/output devices, to provide an interface with a human user. For the purpose of this disclosure it is assumed that all processing activity, which otherwise could be performed on a separate or discrete processing devices, is performed on and by the controller 15. The controller 15 receives these data 11 and processes and/or stores the data in a database 19 provided for that purpose.

Processing of these data 11 can include, without limitation, making an estimation and/or making corrections or adjustments thereto of the total volume of runoff, or quantity (Q), of precipitation during the precipitation event and, in combination with second volume ($V_2$) data from the sensing device 16 discussed hereinbelow; and estimating whether or not the precipitation event will overfill or underfill the maximum storage volume ($V_{MAX}$) of the storage/detention system 14. The first volume ($V_1$) and the maximum storage volume ($V_{MAX}$) can be synonymous. Instances in which the two terms are not may include when it is desired to provide a buffer between the maximum storage volume ($V_{MAX}$) and an allowable maximum storage volume.

The sensing device 16 is adapted to generate data parameter signals 17 having to do with the current volume of water ($V_2$) stored in the storage/detention system 14. As previously mentioned, the controller 15 uses these data parameter signals 17 alone or in combination with the precipitation data 11 to make logic decisions for maximizing and managing the volume of storm water retained in the storage/detention system 14 of the CWSD system 10. Those of ordinary skill in the art can appreciate the myriad of means and devices that are commercially available for determining a volume of water being stored in a CWSD system 10 that has ancillary portions 12 and a storage/detention system 14 of fixed dimensions and capacity. For example, the sensing device 16 can be a pressure transducer, an ultrasonic level sensor, and so forth.

Furthermore, a sensing device 16 can also be provided that is adapted to determine at least one of whether the second volume ($V_2$) is less than a pre-established minimum storage volume ($V_{MIN}$) and whether the second volume ($V_2$) is greater than a pre-established maximum storage volume ($V_{MAX}$). Alternatively, the controller 15 can be adapted to make the determination with respect to the pre-established minimum storage volume ($V_{MIN}$) and pre-established maximum storage volume ($V_{MAX}$).

Optionally, additional sensing devices (not shown) can also be provided within the CWSD system 10 itself to provide indicia of actual volume change and rate of fill data during an on-going precipitation event. For example, a regulator can be integrated into the CWSD system 10 to provide water level signal data to the controller 15, e.g., real-time water level data, and/or a weir can be provided that is adapted to provide signals to the controller 15 when water is or is not flowing over the weir.

Other sensing devices (not shown) can also be disposed within a remote, e.g., downstream, system, which the controller 15 can monitor, to detect a state of the remote system and, moreover, to affect control of the CWSD system 10 accordingly. When these additional sensing devices are monitored manually or automatically, the operating state of the CWSD system 10 is positive (logic 1), which connotes that the remote system is monitored. When there are no remote system sensing devices being interrogated, the operating state of the CWSD system 10 is negative (logic 0), which connotes that the remote system is non-monitored.

Operation of CWSD System and Method of Maximizing/Managing Stored Water Availability Having described a CWSD system 10, operation of that system 10 in the desirable context of maximizing the availability of storm water for use and managing or controlling the same will now be described. Management implies two, mutually-exclusive modes of operation. A first mode involves actively draining or pumping water stored in the storage/retention system to a discharge point. This discharge point can be, for the purpose of illustration and not limitation, a storm sewer, a combined sewer, a separate sewer main, a water infiltration system, a body of water that is available for effluent discharge, and so forth. A second mode of operation involves purposely detaining water in the storage/retention system and, subsequently, using that stored water for non-potable water demands, such as toilets, irrigation systems, water dispersion systems, cooling towers and other industrial demand, the like.

The methods described hereinbelow can be implemented in a hardwired processing device and/or on a computer-readable medium, e.g., software, that is executable on a processing device, e.g., a programmable logic controller (PLC), a single board computer, a microcontroller, and so forth. In addition, a remote central processing device, e.g., a server, using the software, can communicate with field-based microcontrollers or PLCs. Hence, a single central processing device can control one or more CWSD systems located at remote, dispersed sites.

Figure 2:
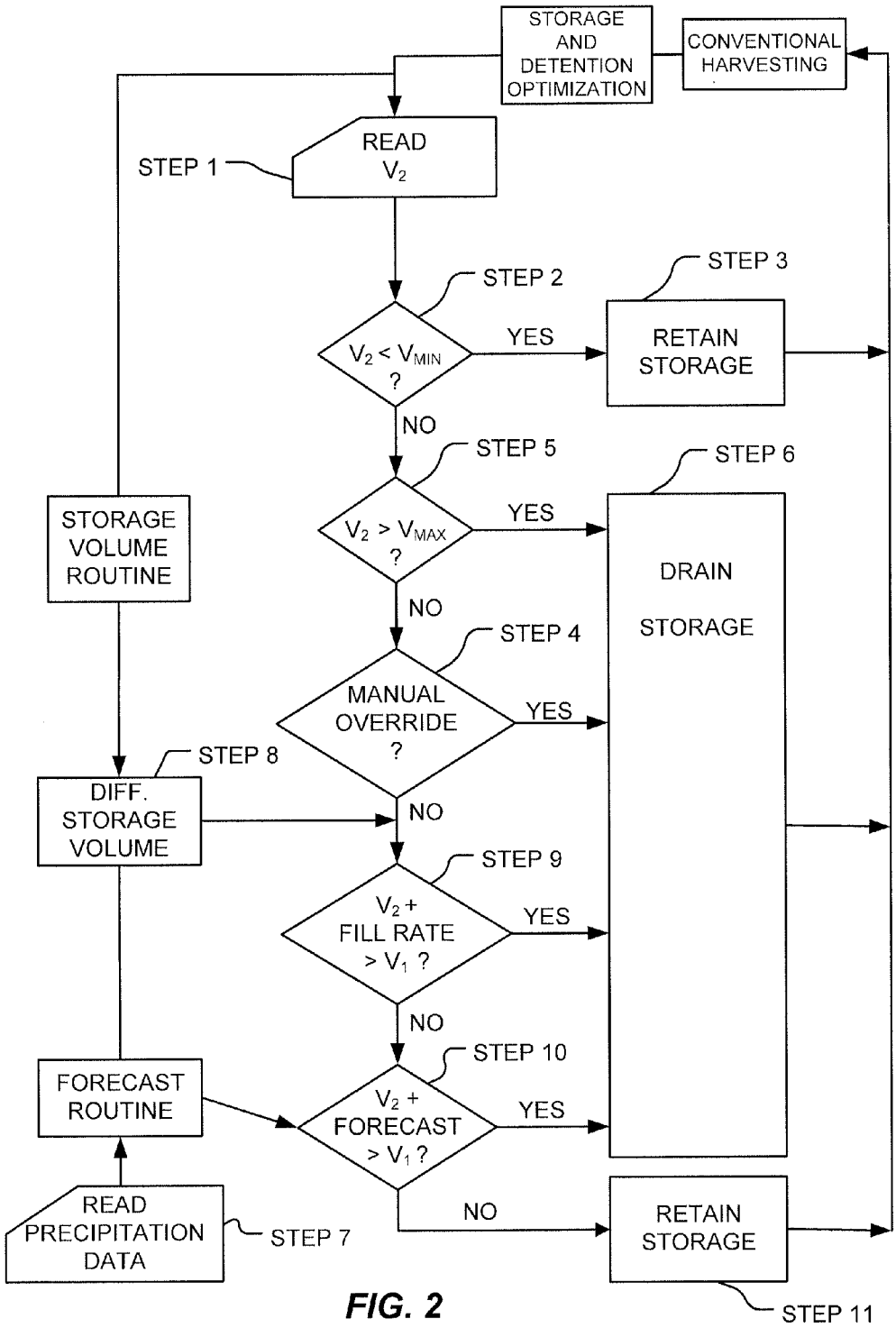
FIG. 2 shows a flow chart of a method of maximizing the availability of water for use in a combined water storage and temporary detention system for a non-monitoring CWSD system (logic 0)

Flow charts for the narrative are provided as FIGS. 2 and 3, which correspond, respectively, to non-monitoring CWSD system operation (negative state, logic 0) and to monitoring CWSD system operation (positive state, logic 1). The terms "monitoring" and "non-monitoring" refer to whether or not additional sensing devices located in a remote system such as a downstream drainage system or receiving water body are interrogated as to the state of the storage capacity of the remote system. Furthermore, data signals generated and transmitted by these devices are integrated into the CWSD system 10 itself to affect the logic of the controller 15 and resulting CWSD system 10 functionality. A "non-monitoring" system does not interrogate the additional sensing devices that are disposed within the remote system and, hence, uses routines that only use predicted or forecast data and calculations based on those data.

Water storage management and control of the stored water resource contained in the CWSD system 10 is based on the following assumptions: (1) that stored water, when available in the storage/detention system 14 can be used for a variety of domestic, municipal, and industrial needs; (2) that the CWSD system 10 is fluidly and operationally coupled to a reserve or back-up reservoir or municipal water supply that can be used for the variety of domestic, municipal, and industrial needs in the event that there is no stored water or limited stored water available in the storage/detention system 14; (3) that water pumps are provided to deliver water to demands applied to the system for use and to optionally enable expedited evacuation of stored water if desired; and (4) that there may be a time delay between activation and deactivation of water pumps, but that gravity drainage is immediately or substantially immediately available.

For example, referring to FIG. 2, there is shown a non-monitoring method. Recalling that the sensing device provides continuous, real-time parameter data on the water level of the storage/detention system 14 (STEP 1), which is to say, the second volume ($V_2$), to the controller 15, initially, it is desirable to compare the second volume ($V_2$) to a predetermined minimum water threshold ($V_{MIN}$) (STEP 2), e.g., five percent (5%) of the maximum storage capacity ($V_1$). If the second volume ($V_2$) is determined to be less than the predetermined minimum water threshold ($V_{MIN}$), i.e., $V_2<V_{MIN}$, then the ancillary devices 12 of the CWSD system 10 are automatically configured to retain any water that enters the CWSD system 10 (STEP 3). This step (STEP 3) can include, without limitation, closing valves and turning off water pumps that discharge water to the downstream water conduits, to a separate sewer system, to a water infiltration system, and/or to a receiving water body as surface water. This step ensures that water that enters the CWSD system 10 is retained, to ensure that a minimum predetermined minimum water threshold ($V_{MIN}$) level is maintained.

When the second volume ($V_2$) is determined to be greater than the predetermined maximum water threshold ($V_{MAX}$), i.e., $V_2>V_{MAX}$, (STEP 5) the system automatically drains stored water from the storage/retention system 14 (STEP 6) until the second volume ($V_2$) is again determined to be less than or equal to the predetermined maximum water threshold ($V_{MAX}$), e.g., 90 percent (90%) of the maximum capacity ($V_1$). This step (STEP 6) can also include, without limitation, opening valves and turning on water pumps to discharge effluent from the CWSD system 10.

Optionally, in instances in which the second volume ($V_2$) is determined to be greater than or equal to the predetermined minimum water threshold ($V_{MIN}$) but the second volume ($V_2$) is determined to be less than the predetermined maximum water threshold ($V_{MAX}$), i.e., $V_{MIN}\leq V_2<V_{MAX}$, (STEP 4), because the embodiment can be monitored by human interface, the human operator may opt to manually drain stored water from the storage/retention system 14 (STEP 6). This step (STEP 6) can include, without limitation, opening valves and turning on water pumps to affect discharge of effluent from the CWSD system 10.

When a precipitation event is imminent, presently occurring, or predicted to occur at some point in time in the future, the non-monitoring method includes monitoring for and/or receiving precipitation data (STEP 7) from a network 21, e.g., the Internet. The data received (STEP 7) can be continuously provided to the precipitation forecast device 18 from a specific source or from multiple sources or can be provided by a specific server in response to a specific request for information from the precipitation forecast device 18. The controller 15 uses precipitation parameter data 11 (STEP 7) in combination with the second volume ($V_2$) data to predict/calculate forecast water addition (STEP 8), i.e., a differential storage volume for use in determining whether to drain stored water from or to retain stored water within the storage/retention system 14 of the CWSD system 10.

For example, a mathematic operation can be used to determine the available water storage volume ($V_3$), such as given by the formula:

$$V_s=V_1-V_2.$$

Precipitation parameter data that provide a predicted or an actual intensity (I) of the future or current precipitation event, the volumetric runoff coefficient (C), and the drainage area (A), can be used to calculate or estimate the quantity (Q) and/or volume (V) of precipitation to be added to the CWSD system 10 and its time-dependency. These calculations/estimations can be optionally used to determine whether or not the predicted fill rate (STEP 9) in combination with predicted duration and intensity parameter for the precipitation event will add a sufficient quantity or volume of water to the CWSD system 10, to exceed the first volume ($V_1$) (STEP 10). If predicted fill rate will cause the storage capacity of the storage/retention system to be exceeded (STEP 9) and/or if the sum of the predicted forecast volume (V) and the second volume ($V_2$) will exceed the first volume ($V_1$) (STEP 10), the system automatically drains stored water from the storage/retention system 14 (STEP 6) until the summation of the second volume ($V_2$) and the estimated volume (V) of precipitation to be added to the CWSD system 10 is equal to of less than the first volume ($V_1$) or the maximum desired storage level ($V_{MAX}$). Time of concentration parameter data and length of the predicted duration of the precipitation event can be used to control the rate of discharge and the timing of the discharge. This feature is particularly advantageous to prevent undesirable discharge of storm water prior to or during a precipitation event that either does not occur at all or that does not meet the expectation of the weather information parameter data. As previously mentioned, this step (STEP 6) can also include, without limitation, opening valves and turning on water pumps to discharge effluent from the CWSD system 10.

On the other hand, if the first volume ($V_1$) will not be exceeded, the ancillary devices 12 of the CWSD system 10 are automatically configured to retain any water that enters the CWSD system 10 (STEP 11). This step (STEP 11) can include, without limitation, closing valves and turning off water pumps that discharge water to the CWSD water conduits. This step again ensures that any water that enters the CWSD system 10 is retained, to maximize capture and water harvesting of the precipitation.

Having described a non-monitoring (negative state) method of maximizing water harvesting, a monitoring (positive state) method will now be described. Referring to FIG. 3, there is shown a flow chart for a monitoring method. STEPS 1-9 and STEP 11 are identical to those previously described in connection with the non-monitored method. Advantageously, providing additional sensing data as to real-time remote system flow rates prevents premature and undesirable drainage of stored water from the storage/retention system 14 (STEP 6) in instances in which discharges from the CWSD system 10 might contribute to combined sewer overflows, surcharging downstream drainage structures and/or receiving water bodies.

For example, if the CWSD system 10 is monitoring a remote system (logic 1) then, even though the weather precipitation data suggests that the volume of water (V) to be added to the CWSD system 10 plus the second volume ($V_2$) is predicted to exceed the first volume ($V_1$) or some logic condition would otherwise result in discharges to the remote system, the method includes evaluating whether actual conditions in the remote downstream system still warrant draining the storage/retention system 14. Without this additional logic step (STEP 12), discharges from the CWSD system 10 could negatively impact the remote system being monitored.

Many changes in the details, materials, and arrangement of parts and steps, herein described and illustrated, can be made by those skilled in the art in light of teachings contained hereinabove. Accordingly, it will be understood that the following claims are not to be limited to the embodiments disclosed herein and can include practices other than those specifically described, and are to be interpreted as broadly as allowed under the law.

What we claim is:

1. A method of maximizing storm water availability for use in a combined water storage and detention (CWSD) system, the system having a plurality of water conduits, remotely controllable water pumps, water storage drain valves, auxiliary bypass discharge valves, and a storage/detention system for storing/retaining a first volume of storm water, the method comprising:

monitoring a second volume of storm water within the storage/detention system, the second volume being less than or equal to the first volume;

receiving precipitation parameter data regarding forecasted precipitation predicted to occur at some point in the future, the parameter data comprising a predicted duration, a predicted intensity and a predicted volume ($V_{pred}$);

estimating an expected time-dependent volume of water ($V_{td}$) be added to the system during the forecasted precipitation based on the predicted duration, the predicted intensity and a system fill rate; and if at least one of: a first sum of the predicted volume ($V_{pred}$) and the second volume and a second sum of the expected time-dependent volume ($V_{td}$) and the second volume is greater than the first volume then controlling the operating states of the remotely controllable water pumps, drain valves, and auxiliary bypass discharge valves to discharge water from the system until each of the first and second sums is not greater than the first volume.

2. The method as recited in claim 1, wherein receiving precipitation parameter data includes receiving weather forecast data from a network source.

3. The method as recited in claim 2, wherein the network source is an on-line network selected from the group consisting of the World Wide Web, the Internet, a local area network (LAN), a wide area network (WAN) or a dedicated weather data server.

4. The method as recited in claim 1, wherein controlling includes closing the water storage drain valves or keeping said water storage drain valves closed when the second volume is less than or equal to a minimum storage volume and opening the water storage drain valves or keeping said water storage drain valves open when the second volume is greater than a maximum storage volume.

5. The method as recited in claim 1, further comprising:

closing the water storage drain valves or keeping said water storage drain valves closed when each of the first and second sums is less than or equal to a minimum storage volume; and opening the water storage drain valves or keeping said water storage drain valves open when at least one of the first and second sums is greater than a maximum storage volume.

6. The method as recited in claim 5, further comprising:

activating at least one of the water pumps and/or at least one of the auxiliary bypass discharge valves when at least one of the first and second sums is greater than the maximum storage volume.

7. The method as recited in claim 1, wherein controlling the operating states comprises:

controlling a rate of opening and/or closing of one or more of: the water pumps, drain valves and discharge bypass valves based on at least one of: the predicted duration and the predicted intensity.

* * * * *